United States Patent [19]

Lin

[11] Patent Number: 4,691,598

[45] Date of Patent: Sep. 8, 1987

[54] CLAMPING APPARATUS FOR HAMMERING A HARDENED NAIL

[76] Inventor: Min-Shin Lin, 116 Yuan tzyy Street, Taichung city, Taiwan

[21] Appl. No.: 844,007

[22] Filed: Mar. 26, 1986

[51] Int. Cl.[4] ..... B25B 9/00

[52] U.S. Cl. ..... 81/44

[58] Field of Search ..... 81/44, 23, 452, 451, 81/125, 458, DIG. 11, 13; 279/41 R

[56] References Cited

U.S. PATENT DOCUMENTS

| | | | |
|---|---|---|---|
| 903,095 | 11/1908 | Johnson | 81/23 |
| 3,060,442 | 10/1962 | Tomek | 81/44 |
| 4,367,778 | 1/1983 | Bradbury | 81/23 |
| 4,422,489 | 12/1983 | Ross | 81/44 |

*Primary Examiner*—Frederick R. Schmidt
*Assistant Examiner*—Bradley I. Vaught
*Attorney, Agent, or Firm*—Browdy and Neimark

[57] ABSTRACT

A clamping apparatus for hammering a hardened nail comprises a nail clamping device adapted to clamp a hardened nail, a ring sleeve receiving the clamping device at it's inner surface and an elongated handle connected at the outer surface of the ring sleeve. The clamping device is a truncated cone made of an elastic material and having an axial through center hole and a longitudinal through groove from the axial hole radially outwards to an outer surface of the cone. The ring sleeve has a tappered inner surface to taperingly engage with the truncated cone. The handle has predetermined length and two ends for connecting different sizes of ring sleeves.

3 Claims, 2 Drawing Figures

CLAMPING APPARATUS FOR HAMMERING A HARDENED NAIL

BACKGROUND OF THE INVENTION

The present invention relates to a clamping apparatus, and more particularly to a apparatus for hammering a hardened nail.

At the present time, most people usually use their fingers to hold a hardening nail for hammering it into a concrete wall. Due to the impetuous vibration of the hammering action, the user's fingers often cannot hold the nail effectively. Therefore the nail not only can not be forced into the wall easily but also is prone to spring back to hurt the user's fingers.

It is therefore an object of the present invention to provide a fast and safe clamping apparatus for hammering a hardened nail.

SUMMARY OF THE INVENTION

According to the present invention, a clamping apparatus for hammering a hardened nail comprises a nail clamping means adapted to clamp a hardened nail, a ring sleeve receiving said clamping device at its inner surface, and an elongated handle which is connected at the outer surface of said sleeve used for a hand grip.

The clamping means is a truncated cone of an elastic material and having an axial through center hole and a longitudinal through groove extending radially outwardly from said axial hole to an axial outer surface of said cone for disengaging said clamped nail and for attaining a flexibility to receive different sizes of hardened nails in said axial hole. The ring sleeve has a tapered inner surface for engaging said truncated cone. The handle can have two ends for connecting different gauges of ring sleeves.

It is therefore an object of the present invention to provide a clamping apparatus capable of preventing a hardened nail from hurting the user while he is hammering.

It is another object of the present invention to provide a clamping apparatus capable of effectively assisting in the hammering of nails into hard surface constructions easily and quickly.

These and other advantages of the present invention may best understood with reference to the drawings, in which:

DETAILED DESCRIPTION OF THE PREFERRED EMBODIMENT

Figure 1:
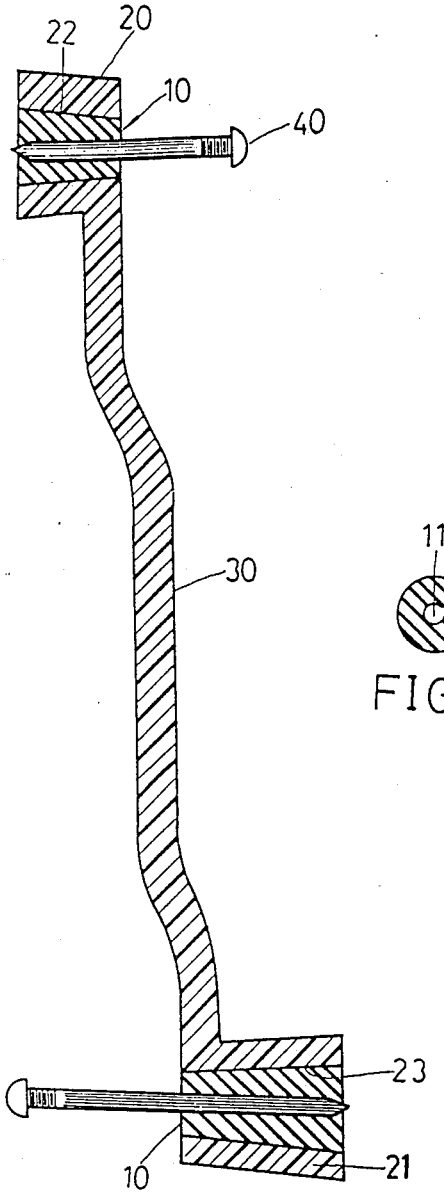
FIG. 1 is a section view of a clamping apparatus for a hardened nail of the present invention.

Referring now to FIG. 1, there is shown a clamping apparatus for hammering a hardened nail, which includes a clamping means 10, a first ring sleeve 20, a second ring sleeve 21 and an elongated handle 30; Clamping means 10 can clamp a hardened nail 40.

Figure 2:
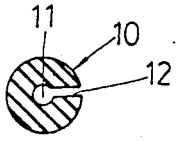
FIG. 2 is a side view of a clamping means of the present invention.

Clamping means 10 is a truncated cone made of an elastic material and having an axial through center hole 11 and a longitudinal through groove 12 extending radially outwardly from the axial center hole 11 to an axial outer surface of the cone for disengaging a clamped nail 40 therefrom and for attaining a flexibility to receive different gauges of hardened nails in the axial hole 11, as shown in FIG. 2.

First and second ring sleeves 20, 21 have the same structure but differ in gauge. The inner surface 22, 23 of said ring sleeve 20, 21 are taperd to taperingly engage with the clamping means 10.

Handle 30 has predetermined length in its longitndinal axis for the user's hand grip. The said first and second ring sleeves 20, 21 are connected at the opposite ends of said handle 30. When made of plastic or light material, the ring sleeves 20, 21 and handle 30 are integrally formed with the body.

In operation, the user first puts hardened nail 40 into the axial through center hole 11 of the clamping means 10. The clamping means 10 is then inserted into the inner surface of said ring sleeve 20 or 21 from its large end which will be in a state that the clamping means is firmly engaged with the inner tapered surface of said ring sleeve 20 or 21.

Then the user grips the handle 30 with one hand to place the large end of the ring sleeve 20 or 21 against the concrete wall. At this time, the user can use the hammer with another hand impinging upon the head of the hardened nail 40 until the nail 40 is driven into the wall to an adequate depth. Finally the ring sleeve 20 or 21 is pulled out from the clamping device 10 in a back direction and the clamping means 10 is taken away from the hardened nail 40. It must be mentioned that the pull out action is in a direction from the large end to the small end. After taking of off the clamping means 10, the user can continue striking the nail 40 into the wall to a desirous depth without any clamping action.

While the invention has been described in connection with what is presently considered to be the most practical and preferred embodiment, It is to be understood that the invention is not to be limited to the disclosed embodiment but on the contrary, is intended to cover various modifications and equivalent arrangements included within the spirit scope of the appended claims which scope is to be accorded the broadest interpretation so as to encompass all such modifications and equivalent structures.

What I claim is:

1. A clamping apparatus for assisting in the hammering of a hardened nail, comprising a clamping means adapted to clamp a hardened nail, said clamping means comprising a truncated cone made of an elastic material and having an axial through center hole and a longitudinal through groove extending radially outwardly from said axial hole to an axial outer surface of said cone, said longitudinal through groove being for disengaging a clamped nail from said center hole and for achieving a flexibility for receiving hardened nails of different gauge within said axial hole;

a ring sleeve having an outer surface and a tapered inner surface for receiving therein said truncated cone clamping means; and an elongated handle connected to the outer surface of said ring sleeve.

2. A clamping apparatus according to claim 1 wherein said elongated handle has a second ring sleeve at an end opposite to said first mentioned ring sleeve.

3. A clamping apparatus according to claim 2 wherein said first mentioned ring sleeve is of a size different from said second mentioned ring sleeve.

* * * * *